US005353557A

United States Patent [19]

Lerner et al.

[11] Patent Number: 5,353,557

[45] Date of Patent: Oct. 11, 1994

[54] MODULAR JAIL SYSTEM AND METHOD OF PREPARING SAME

[75] Inventors: Marc Lerner, Swan Lake; William A. Bertolini, West Coxsackie, both of N.Y.

[73] Assignee: Quickway Metal Fabricators, Inc., Monticello, N.Y.

[21] Appl. No.: 983,631

[22] Filed: Dec. 1, 1992

[51] Int. Cl.[5] ..... E04H 1/00; E04H 3/00; E04H 3/08

[52] U.S. Cl. ..... 52/106; 52/79.1; 52/79.4; 52/79.9

[58] Field of Search ..... 52/79.1, 79.6, 79.9, 52/106, 234, 79.4

[56] References Cited

U.S. PATENT DOCUMENTS

| | | | |
|---|---|---|---|
| 4,073,099 | 2/1977 | van der Lely et al. | 52/79.1 X |
| 4,599,829 | 7/1986 | DiMartino, Sr. | 52/106 X |
| 4,754,584 | 7/1988 | Newton, II | 52/106 |
| 4,788,802 | 12/1988 | Wokas | 52/79.1 |
| 4,970,834 | 11/1990 | Polson | 52/106 |
| 5,261,197 | 11/1993 | Pickle, Sr. | 52/106 |

OTHER PUBLICATIONS

Mark Correctional Systems, Inc., *The Mark Cellular System Catalog.*

*Primary Examiner*—Neill R. Wilson

*Attorney, Agent, or Firm*—Curtis, Morris & Safford

[57] ABSTRACT

The present invention is directed to a modular jail structure comprising a plurality of removable cells in adjacent relation arranged in a configuration to form an open area, a plurality of support columns removably coupled to the plurality of cells, and a roof supported by the plurality of support columns, covering at least the open area, such that the roof remains in place, supported by the support columns, when the plurality of cells are removed. It is also directed to a method of preparing and dismantling a jail facility comprising the steps of pre-fabricating a plurality of jail cells at a first site, preparing a foundation comprising at least one slab at a second site, transporting the plurality of jail cells to the second site, arranging the plurality of jail cells in at least one level in a configuration on at least one slab to create a central open area, coupling a plurality of support columns to the cells, erecting a roof supported substantially only by the support columns, and removing the arranged cells, when use of the jail facility is complete, leaving intact the roof supported by the support columns.

26 Claims, 22 Drawing Sheets

FIG. 4
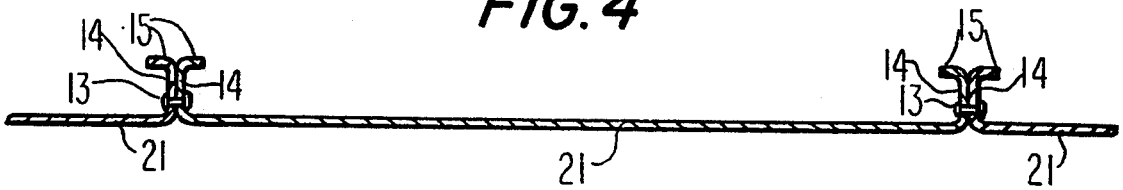
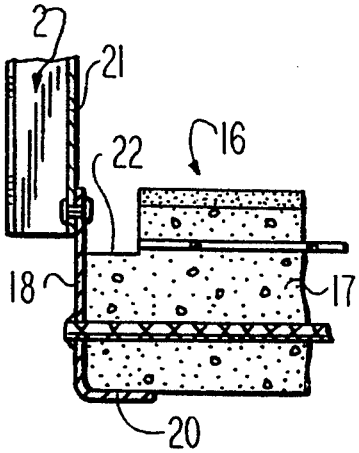
FIG. 5
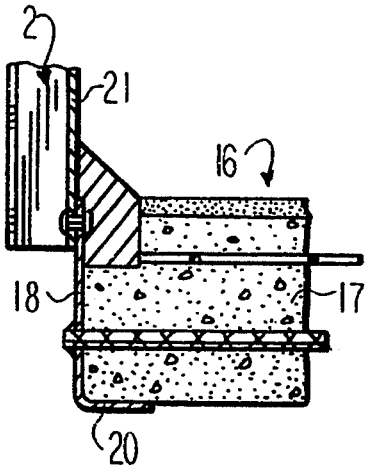
FIG. 6
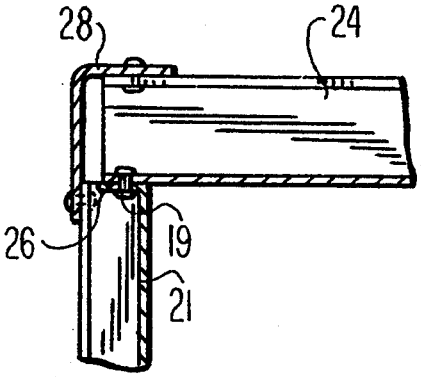
FIG. 7

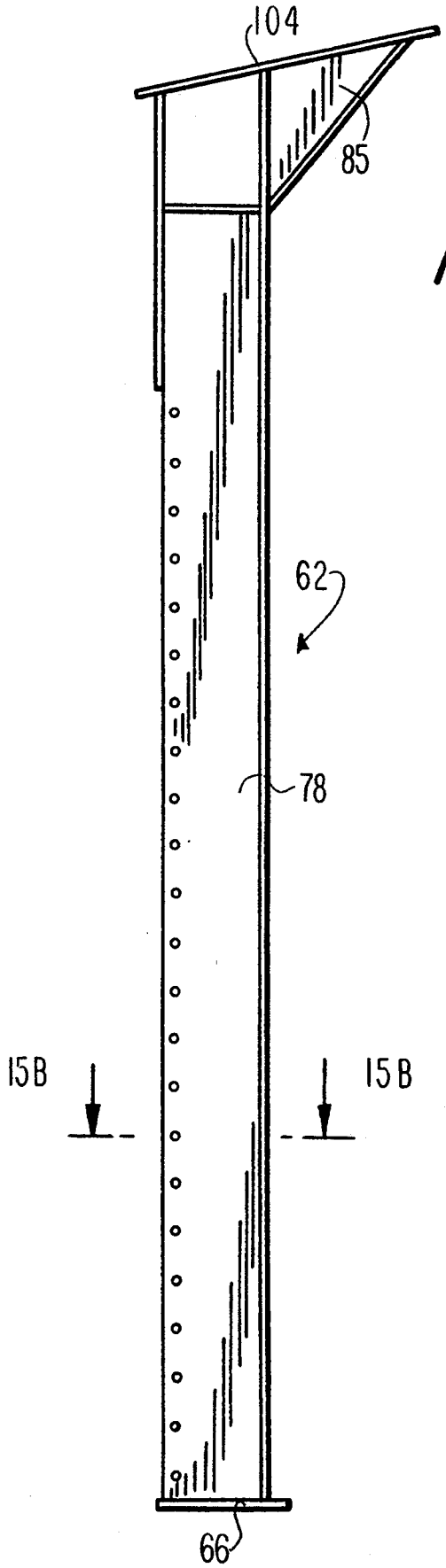
FIG. 15A
FIG. 15B
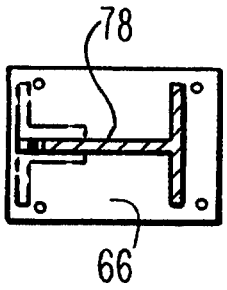

MODULAR JAIL SYSTEM AND METHOD OF PREPARING SAME

FIELD OF THE INVENTION

The present invention relates generally to jail facilities and more particularly to modular jail facilities which can be quickly constructed and/or dismantled.

BACKGROUND OF THE INVENTION

The establishment of a jail facility in a given location is an inherently controversial undertaking. Few communities want to have a prison near their environs. Thus, when a site has been chosen, one method of allaying a community's fears is to emphasize the ability of the jail facility to be easily dismantled or relocated when the need for its services no longer exists.

Many prisons have been judicially determined to be overcrowded. In order to comply with court imposed conditions, governmental bodies have been forced to find relatively quick means by which such overcrowding can be alleviated. Thus, it has become crucial for the construction industry to provide for the accelerated creation of additional jail space on new or existing prison sites.

Finally, as older prisons deteriorate to the point of uninhabitability, their replacement and/or repair becomes necessary. This results in a need for jail facilities which can be put into use expeditiously. Thus, the inexpensive establishment of facilities which are capable of serving as either temporary or permanent facilities is extremely desirable.

Efforts have been made to address the above problems by the development of "modular" jail systems. Such systems generally rely on pre-fabricated cells or cell components which can be combined at a selected site to create or augment an operational prison facility. At least three types of modular jail systems are generally available: pre-cast concrete, trailers and steel cellular.

Pre-cast concrete systems use pre-formed, finished or unfinished concrete cells which are arranged on-site. The cells may be finished at the site and appropriate fixtures added. Finally, a roof and other elements are added to complete the jail facility. Alternatively, they may be installed in an existing or new building.

Pre-cast concrete systems have several drawbacks: they take a relatively long time to construct; they require a significant amount of on-site fabrication; they are extremely heavy, thereby requiring substantial support structure; and they are subject to deterioration caused by human and natural elements.

Trailer systems employ cell units (one or multiple cells) which are completely pre-assembled. These units are typically deployed outdoors within a secure perimeter. If the jail facility is to be an indoor facility, the trailers must be brought into a building built to the appropriate security standards and anchored in place.

Trailer systems are, by their nature, temporary installations. While they can quickly be placed into service, they cannot be satisfactorily used in high inmate population situations (in part because they cannot be readily deployed in multiple levels) and because of the difficulty in integrating them to the ancillary areas required for a full detention facility. Finally, trailers require substantial maintenance to remain habitable and secure over time, primarily due to their typically flimsy construction.

Steel cellular systems, such as the Mark Cellular System, provide a cost effective, quickly established, low maintenance alternative to other modular systems. The cells of these systems are totally pre-fabricated. On-site, they are simply secured in position. Either a building is built to surround the cells or a roof is mounted directly on them. The low weight, resistance to corrosion and the flexibility provided by a steel cellular system overcome many of the problems associated with the pre-cast concrete and trailer options.

While steel cellular systems are generally superior to other modular systems, they are not without their own drawbacks. For example, as noted above, these systems require that either a complete building be constructed to house the cells or a roof be erected directly on the modules. In the latter case, no structure remains when the cell modules are removed. In the former case, the building must be substantially dismantled when the cell modules are removed or made overly large to accommodate a temporary entryway/exitway. Still further, when cells are used within a secondary building, dead space is created between the walls of the cells and the walls of the building. This is a potential security problem since prisoners may be able to secrete themselves or other things in that dead space.

OBJECTS OF THE INVENTION

Accordingly, it is an object of the present invention to provide a cost effective modular jail system which can be easily dismantled with the option of leaving behind a usable structure.

It is another object of the present invention to provide a modular jail system which does not require a separate building for containment of modular cells.

It is a further object of the present invention to provide an efficient arrangement of modular cells within a complete modular prison system, enclosing a central day room area.

It is yet another object of the present invention to provide an efficient layout of a complete prison system incorporating modular jail cells arranged in manageable groups that can be combined into a prison facility with the most efficient utilization of supervisory personnel.

SUMMARY OF THE INVENTION

The present invention is directed to a modular jail system, preferably of the cellular steel type, which associates a plurality of columns with a number of modular jail cells such that the columns support an otherwise freestanding roof. This construction permits the cells to be removed while leaving behind a structure immediately capable of serving as a gym, recreational pavilion, or the like. With the simple replacement of side walls, the structure can be used as a warehouse, a edifice for civic functions or the like. This configuration thus substantially enhances the overall value and utility of the system to the municipality.

The modular jail cells of the present invention are preferably deployed in rectangular wings with the cells arranged in a quadrangle or 'U'-shape which may be subdivided by fire walls to limit the number of inmates for which a guard or guards are responsible. These wings may then be arranged in any configuration around or adjacent to an administration building, joined by secure corridors. This arrangement provides maximum security while making efficient use of space.

A complete jail facility made in accordance with the present invention may be built and dismantled by prefabricating a plurality of jail cells, columns, and roof panels at a first site, preparing a foundation comprising at least one slab at a second site, transporting the plurality of jail cells to the second site, arranging the plurality of jail cells in at least one level in a configuration on the slab to create a central open area, coupling a plurality of semi-dependent support columns to the cells, and erecting the roof panels supported substantially only by the support columns. When use of the jail facility is no longer required, the knockout panels are unbolted, permitting the cells to be removed leaving the roof intact supported by the columns.

BRIEF DESCRIPTION OF THE DRAWINGS

In the drawings:

FIG. 4 is an elevation of a chase side sidewall and cross-sectional view of a joint between wall panels made in accordance with one embodiment of the present invention;

FIG. 5 is a plan and cross-sectional view of the floor of a cell made in accordance with one embodiment of the present invention;

FIG. 6 is a cross-sectional view of a floor to wall joint of a cell made in accordance with one embodiment of the present invention;

FIG. 7 is a cross-sectional view of a roof to wall joint of one embodiment of the present invention;

FIG. 15*a* is a side view of a column made in accordance with the 'T' beam embodiment of the present invention;

FIG. 15*b* is a cross-sectional view of the column of FIG. 15*a* taken along line B—B;

DETAILED DESCRIPTION OF A PREFERRED EMBODIMENT

Figure 1:
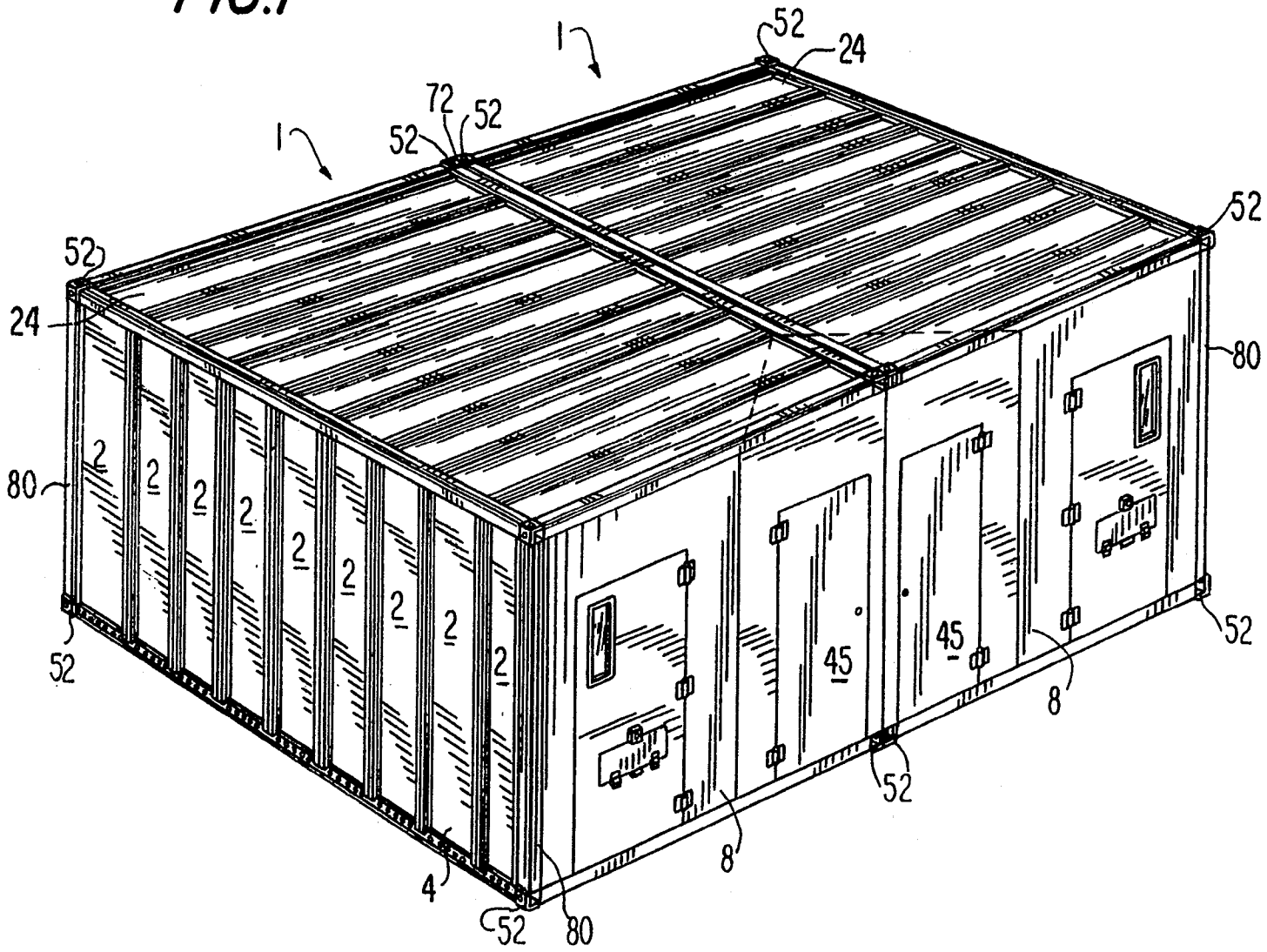
FIG. 1 is a perspective view of a pair of modular jail cells made in accordance with one embodiment of the present invention.

As shown in FIG. 1, modular jail cells, made in accordance with the present invention are generally identified with the reference numeral 1. The cells 1 are preferably prefabricated at an external facility and transported to the appropriate prison site. The cells 1 are then joined together with other components at the site to form a complete structure 100 (see FIG. 2 described below).

Figure 3:
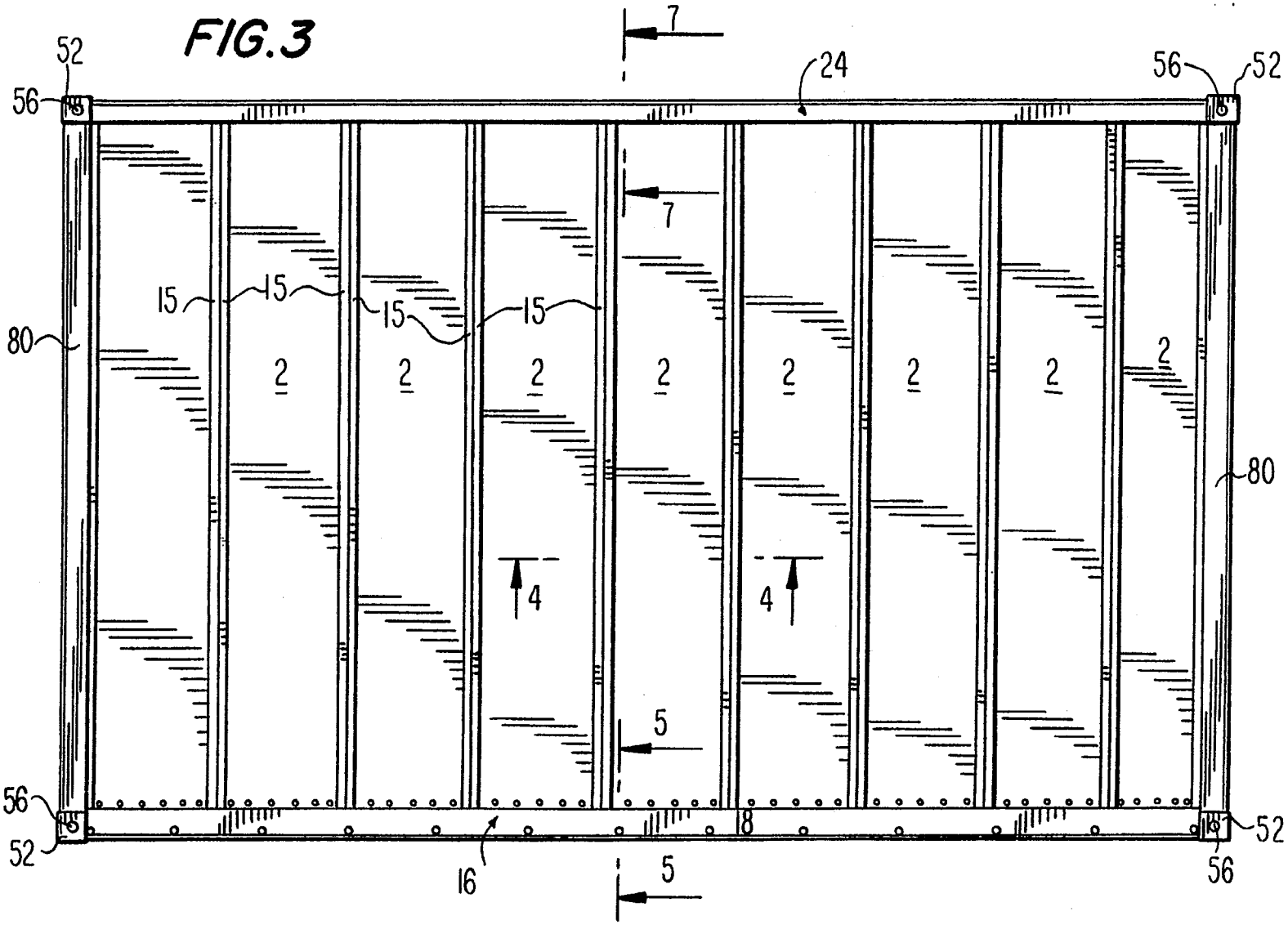
FIG. 3 is an elevation of the wall construction of a cell made in accordance with one embodiment of the present invention.

As shown in FIG. 3, when a cell 1 is fabricated, a plurality of panels 2 are bolted or riveted together to form the sides 4, 6, front 8, chase 10, and back walls 12 of the cell 1. The panels 2 are bent 90 degrees at their edges to form abutting flanges 14 which are fastened together with rivets, bolts or the like 13, as shown in FIG. 4. The panels may also be welded together. Secondary flanges 15, which are bent an additional 90 degrees from the flanges 14, render the overall shape of the panel edges in the form of a 'C', and provide strength and stiffness as well as a surface for attaching external facings such as aluminum siding or the like if desired, and to entrap fireproofing and sound deadening material 15*a*. The bent flange configuration 14 makes the fasteners 13 inaccessible to inmates.

The floor 16 of each cell 1 is preferably constructed primarily of concrete. The use of concrete, as opposed to steel in prior art systems, significantly reduces the ability of inhabitants of a cell 1 to generate noise. As shown in FIG. 5, the floor 16 comprises a reinforced concrete base 17 surrounded, on all sides, by a metal frame 18. The steel reinforcements are spaced to prevent escape if the concrete is broken through. The base 17 is supported on the bottom by flanges 20 which are integral with the frame 18. When the base 17 is fabricated, a groove 22 is left around its top edge to provide room for the use of fasteners to attach the frame to the walls 4, 6, 8, 10 and 12 of the cell 1. Once these walls are attached, by rivets or other fasteners, the groove 22 is then filled, as shown in FIG. 6, with epoxy cement or the like to prevent access to the fasteners. Preferably, the floor 16 is sloped away from the walls 4, 6, 8 and 12 toward a drain (not shown) adjacent the chase wall 10. This permits the cell floor 16 to be hosed down when a quick and/or thorough cleaning is desired.

The ceiling 24 of the cell 1 is constructed in the same manner as the walls 4, 6, 8, 10 and 12 and is comprised of the same or similar panels 2 joined with fasteners 13 along flanges 14. The ceiling 24 is attached to the walls 4, 6, 8, 10 and 12 at its edges with fasteners 19 which fit into pre-cut holes in secondary flanges 26 of panels. These secondary flanges 26 extend outwardly at 90 degrees from the top inner face 21 of the walls 4, 6, 8, 10 and 12 as shown in FIG. 7. A corner angle member 28 is then welded or fastened over the ceiling-to-wall joint to square off the cell 1.

Figure 8:
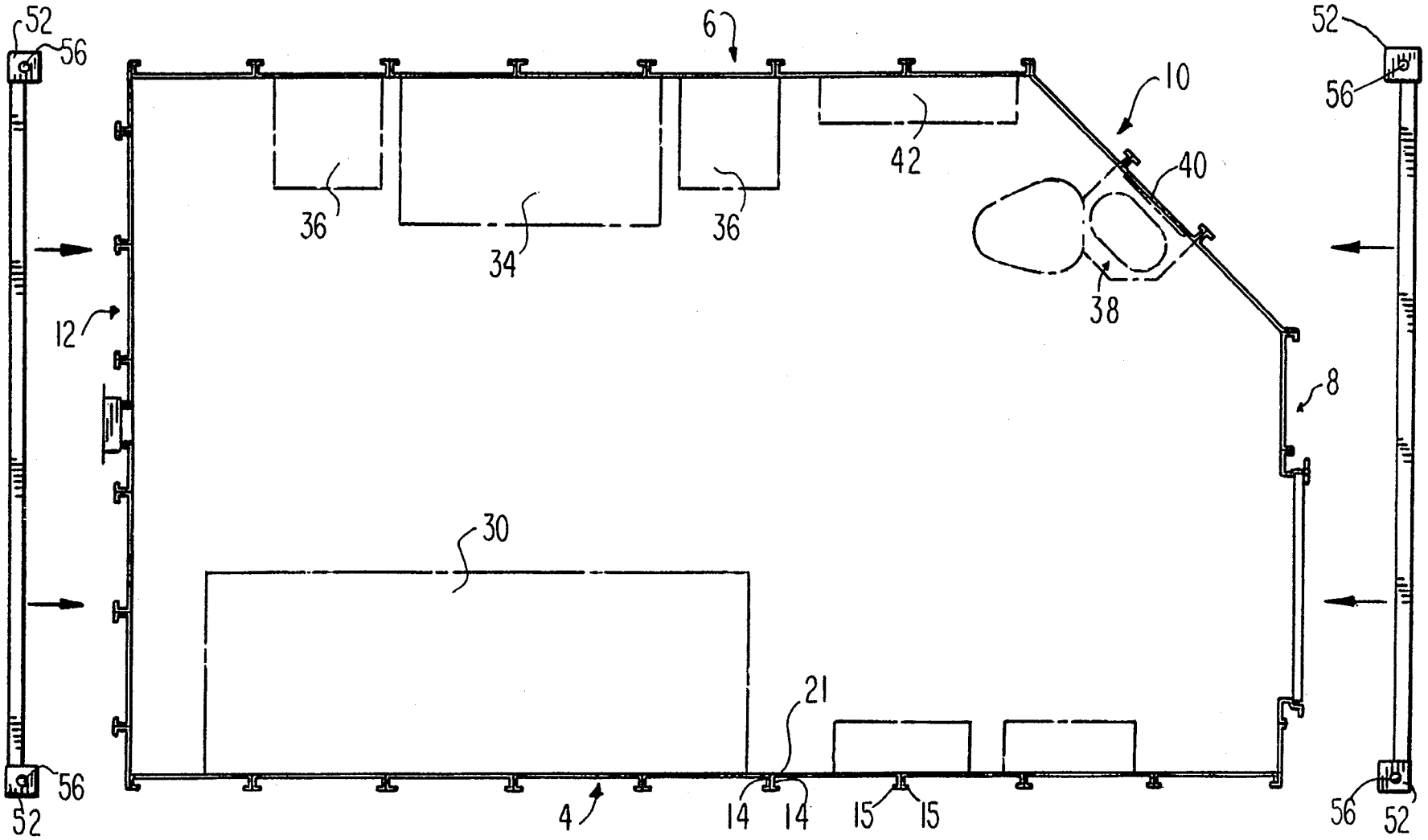
FIG. 8 is a plan view of a cell of one embodiment of the present invention.

Each cell 1 is typically fitted with specialized fixtures including one or two bunks 30, a table and stool combination 36, a sink and toilet 38, a mirror 40 and a light 42 (see FIG. 8). These fixtures are commercially available from various suppliers and are specifically designed for use in prisons.

The chase wall 10 of the cell 1 cuts off what would otherwise be a front corner of the cell 1. Located directly behind the chase wall 10 are the plumbing, heating and cooling ("HVAC") systems for the cell 1. As shown in the layout in FIG. 9, by arranging two chase walls 10 in a back-to-back configuration, a triangular utility area (chase) 43 is created between each pair of cells 1. The utility area (chase) 43 is accessible via a door 45, preferably fitted with a lock, which provides a secure means by which repairs can be effected to the cells' plumbing and HVAC systems.

Figure 2:
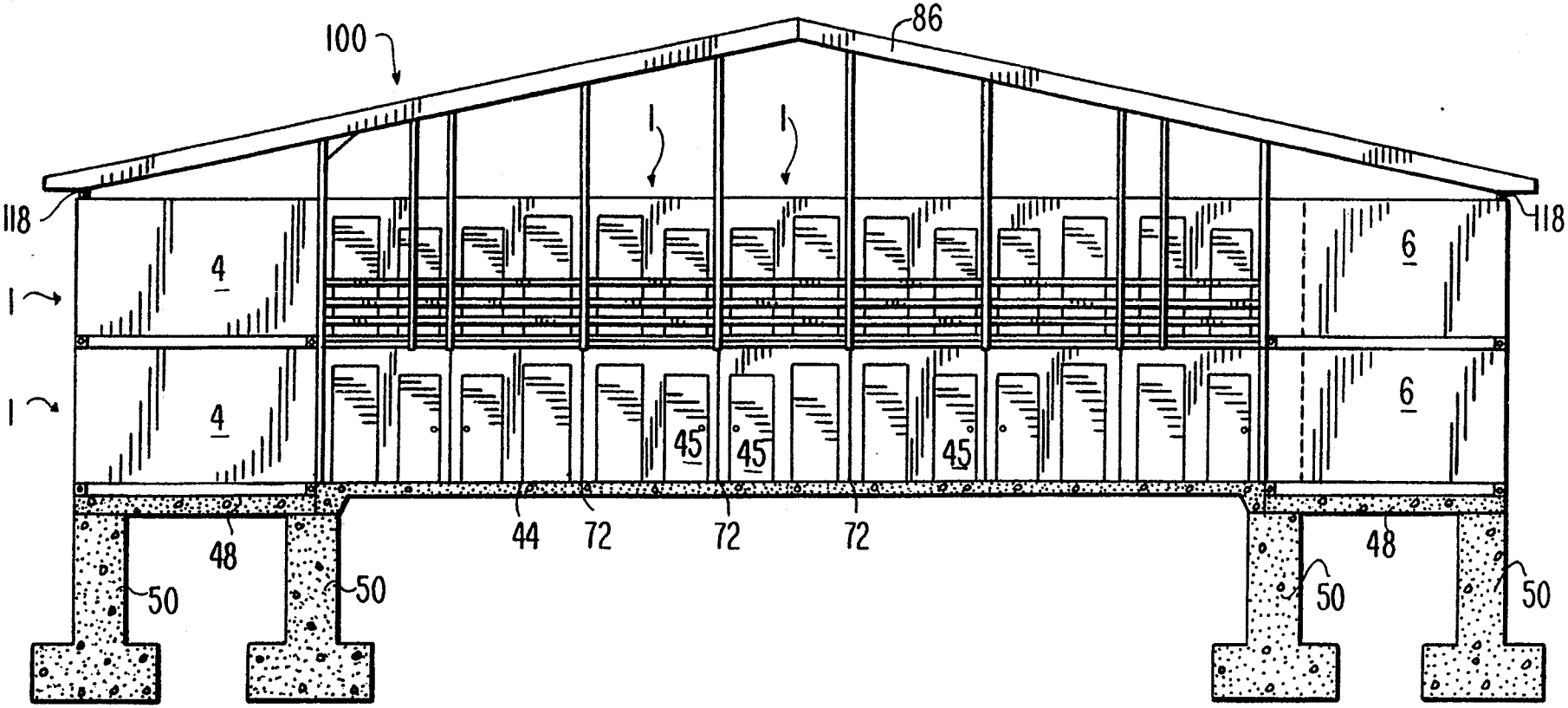
FIG. 2 is a cross-sectional view of the complete structure of a wing made in accordance with one embodiment of the present invention.
Figure 9:
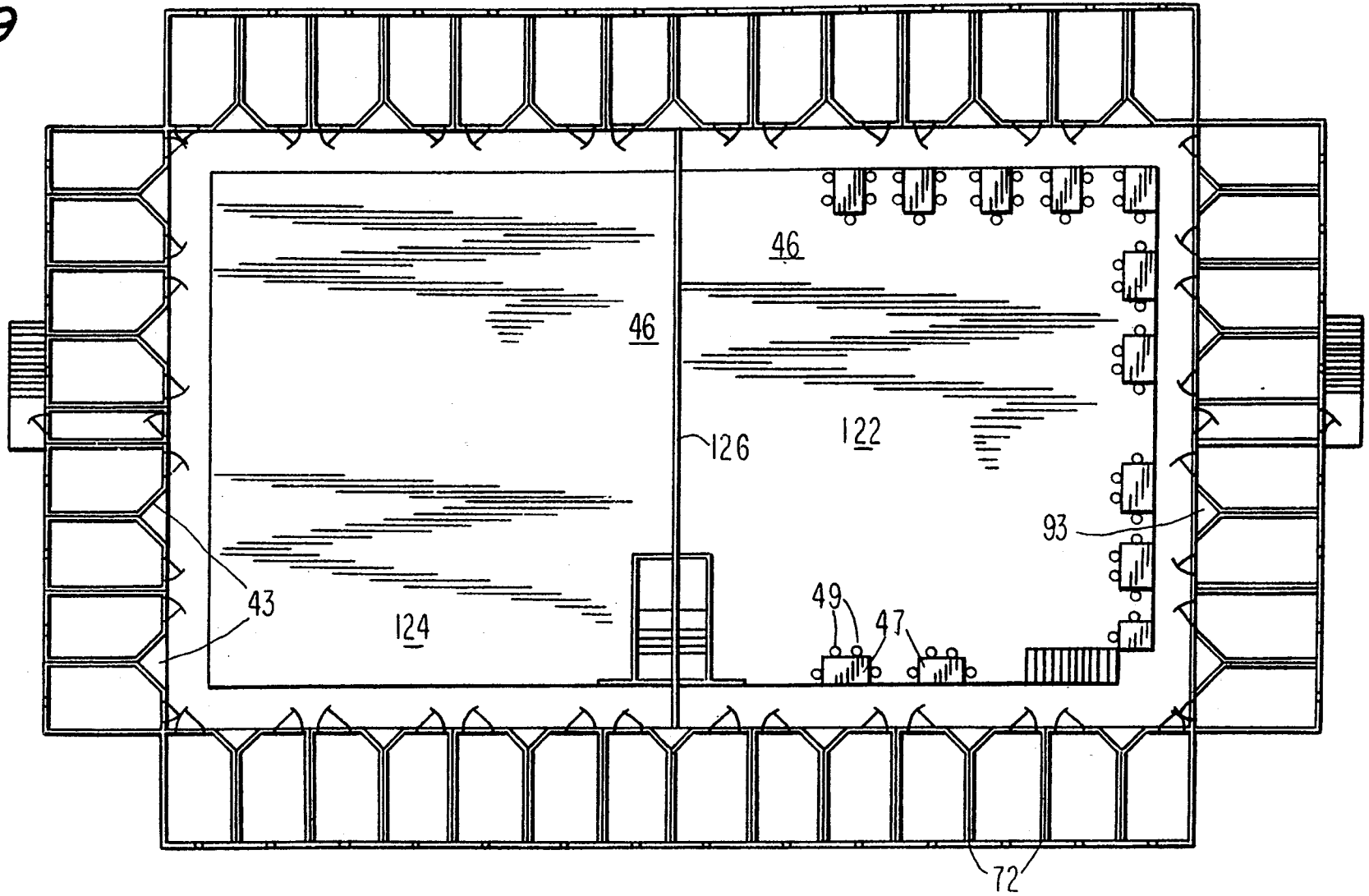
FIG. 9 is top plan view of a wing of one embodiment of the present invention.

As shown in FIGS. 2 and 9, the cells 1 are preferably arranged in a bilevel configuration, in a rectangular grouping around an open area, into a wing 120. Single tier, as well as multiple tier arrangements are possible. By dividing a group of rectangularly organized cells with a secure fire wall 126, a manageable number of prisoners may be housed (e.g. in accordance with governmental regulations) such that one guard may be placed on duty in each wing at a time. However, the modular cells 1 of the present invention provide enormous flexibility, and can thus be arranged in virtually any desired pattern providing any guard-to-prisoner ratio desired.

The open area or common area 46 of the wing 120 is formed as part of the interior space of the jail facility. Solid walls separate these spaces into areas in the quad allocated to each wing. Specialized fixtures such as tables 47 and seats 49 are preferably located in the common area 46 to provide eating facilities for the inmates. An elevated guard post is also preferably provided to house a guard to enhance the security of the circulating guard(s) on duty, to permit a clear view of each wing and its entire common area 46 at all times, as well as a separated exercise yard 133, and to facilitate control of all cell doors and surveillance cameras.

Figure 12:
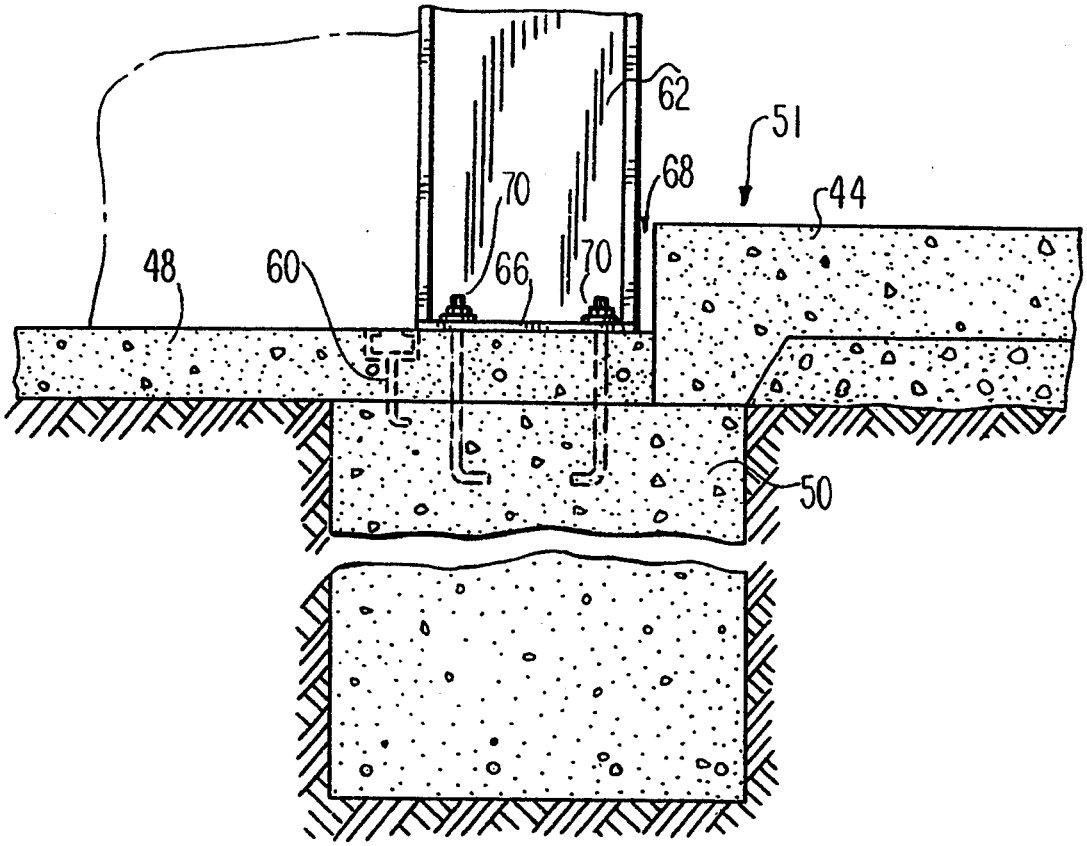
FIG. 12 is a cross-sectional view of one embodiment of a column-foundation interaction of the present invention.

Before the cells 1 are put in place, a foundation 51 is prepared at the site. As shown in FIG. 12, the foundation 51 comprises two slab portions. A first, raised slab portion 44, forms the main floor for the common area 46 of a grouping of cells. A second, lowered slab portion 48, supports the cells 1 as they are deployed around the periphery of the common area 46. This brings the cell floor 16 (constructed as shown in FIG. 6) to a level even with the main floor of the common area 46. The slab portions 44 and 48 are typically supported by footings 50 prepared in accordance with standard building practices.

Figure 10:
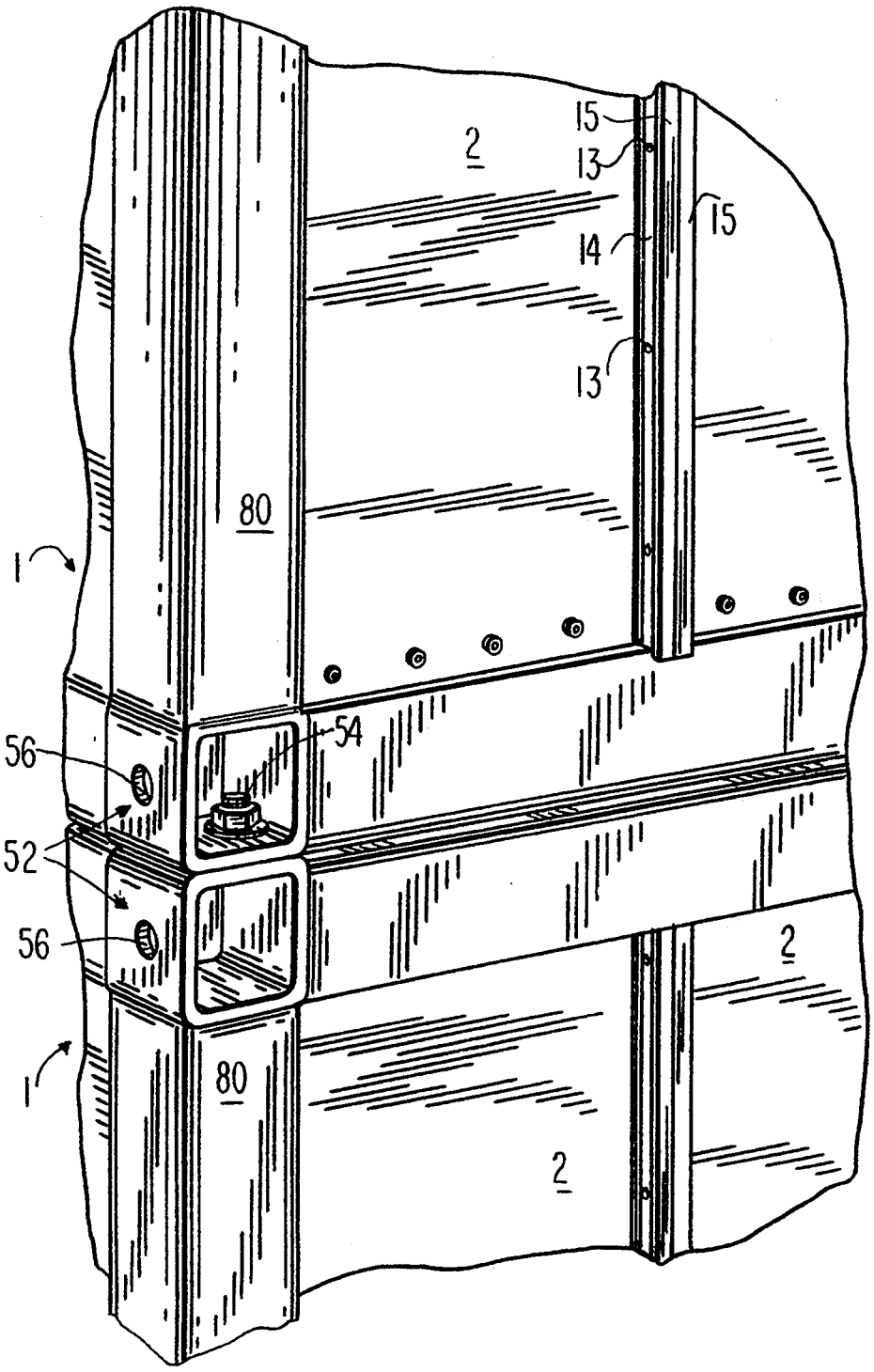
FIG. 10 is a perspective view of a corner joint between an upper and lower cell of one embodiment of the present invention.

As shown in FIG. 10, the bilevel arrangement of cells 1 are joined together, one on top of the other, and in side-by-side relation by bolts 54 fitted through two holes 56 in corner members 52. The corner members 52 are joined to the cells via corner posts 80 and are preferably in the shape of a cube with at least one side omitted to provide bolt 54 access to the holes 56 and tool access to the bolts 54. The two holes 56 of each corner member 52 are located in the downward or (upward) and outside faces of the sides of each corner member. At least eight corner members 52 are attached to each cell 1 providing the ability to establish four points of connection between each adjacent cell (i.e. those cells next to and/or below a given cell).

Figure 11:
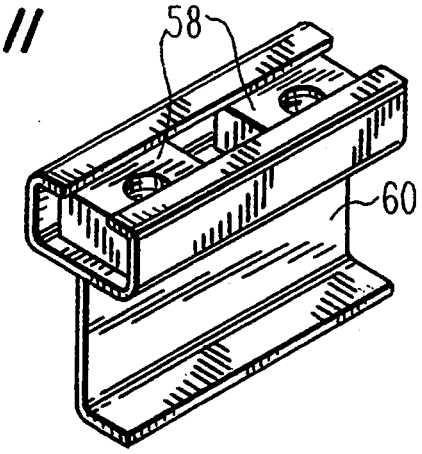
FIG. 11 is a perspective view of an anchor angle and floating nut system of one embodiment of the present invention.

Each lower level cell is preferably connected to the lower slab portion 48 of foundation 51 by fitting bolts 54 through the downward facing holes 56 in the four corner members 52 on the bottom of the cell 1. The bolts 54 are then threaded into floating nuts 58 set in anchor angles 60 (see FIGS. 11 and 12) cast into the lower slab portion 48 at appropriate locations.

A plurality of columns 62 are affixed to the foundation 51 where the lower slab portion 44 joins raised the slab portion 48, as illustrated in FIG. 12. These columns 62 are preferably spaced about 17 feet apart and are connected to or at least associated with a portion of the cells 1. However, the columns form no part of the structural support of the cells.

Figure 13A:
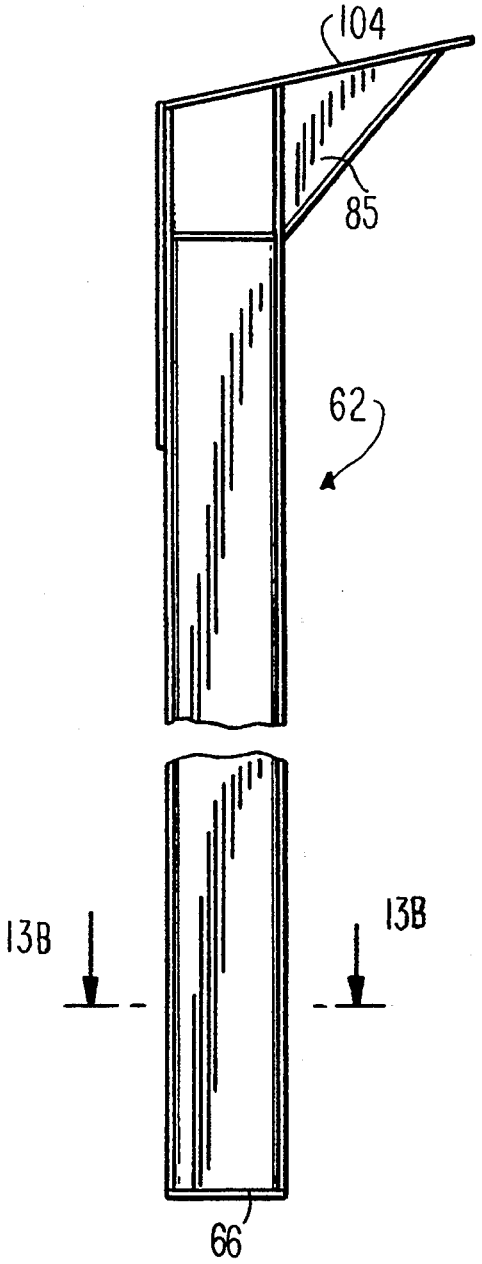
FIG. 13*a* is a side view of a column made in accordance with the I-beam embodiment of the present invention.
Figure 14A:
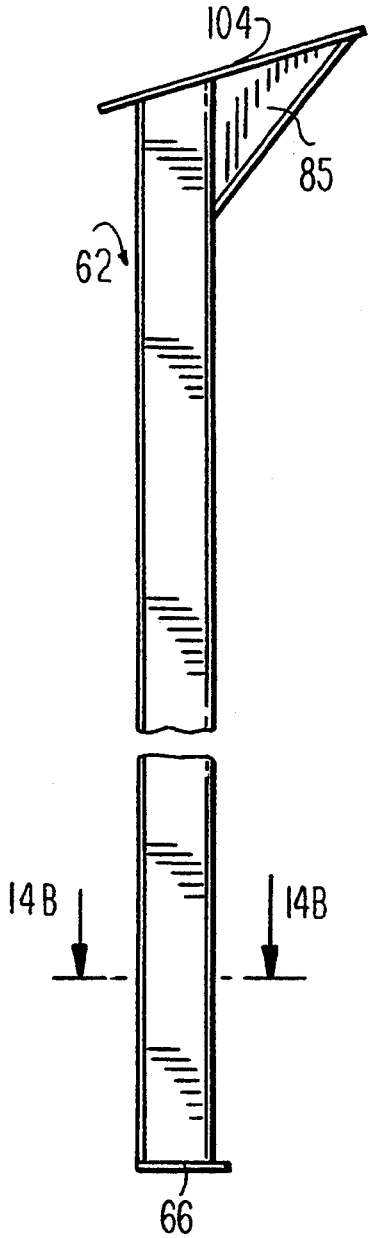
FIG. 14*a* is a side view of a column made in accordance with the hollow beam embodiment of the present invention.
Figure 13B:
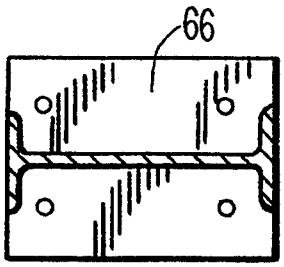
FIG. 13*b* is cross-sectional view of the column of FIG. 13*a* taken along line B—B.
Figure 14B:
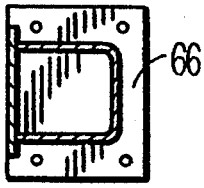
FIG. 14*b* is a cross-sectional view of the column of FIG. 14*a* taken along line B—B.

In one embodiment of the present invention the columns 62 are formed as 'I' beams (see FIGS. 13*a* and 13*b*). In another embodiment the columns are hollow, comprising a U-shaped column body welded to a backing plate (see FIGS. 14*a* and 14*b*). In yet another embodiment the columns are beams in the form of 'T's, the stems of which increase in width towards their top ends (see FIGS. 15*a* and 15*b*). In this embodiment, holes are precut in the outboard edge of the stem of the 'T' to accept bolts and angles or T's to be fastened to the 'T' for stiffness after the cells are removed.

As shown in FIGS. 12, 13*a* and *b*, 14*a* and *b* and 15*a* and *b*, to initially secure the columns 62 in place, each I-beam, T-shaped or U-shaped column has a plate 66 welded to its bottom which has holes for accepting a plurality of anchor bolts 70. In the I-beam and U-shaped column embodiments a channel 68 is left between the lower slab portion 48 and the raised slab portion 44. In these embodiments, anchor bolts 70 or floating nuts (FIG. 11) are cast in the concrete below the channel 68 in such a manner as to mate with the holes in each column's plate 66, thereby providing a means to anchor the columns 62 to the foundation. The channel 68 is then filled with concrete to the level of the raised slab portion 44.

In the T-shaped column embodiment a wide channel 68 is not necessary. The plate 66, welded to the bottom of the column 62, is fastened to the slab portion 48 and/or the grade beam 50 by floating nut (FIG. 11), as previously described.

Figure 16:
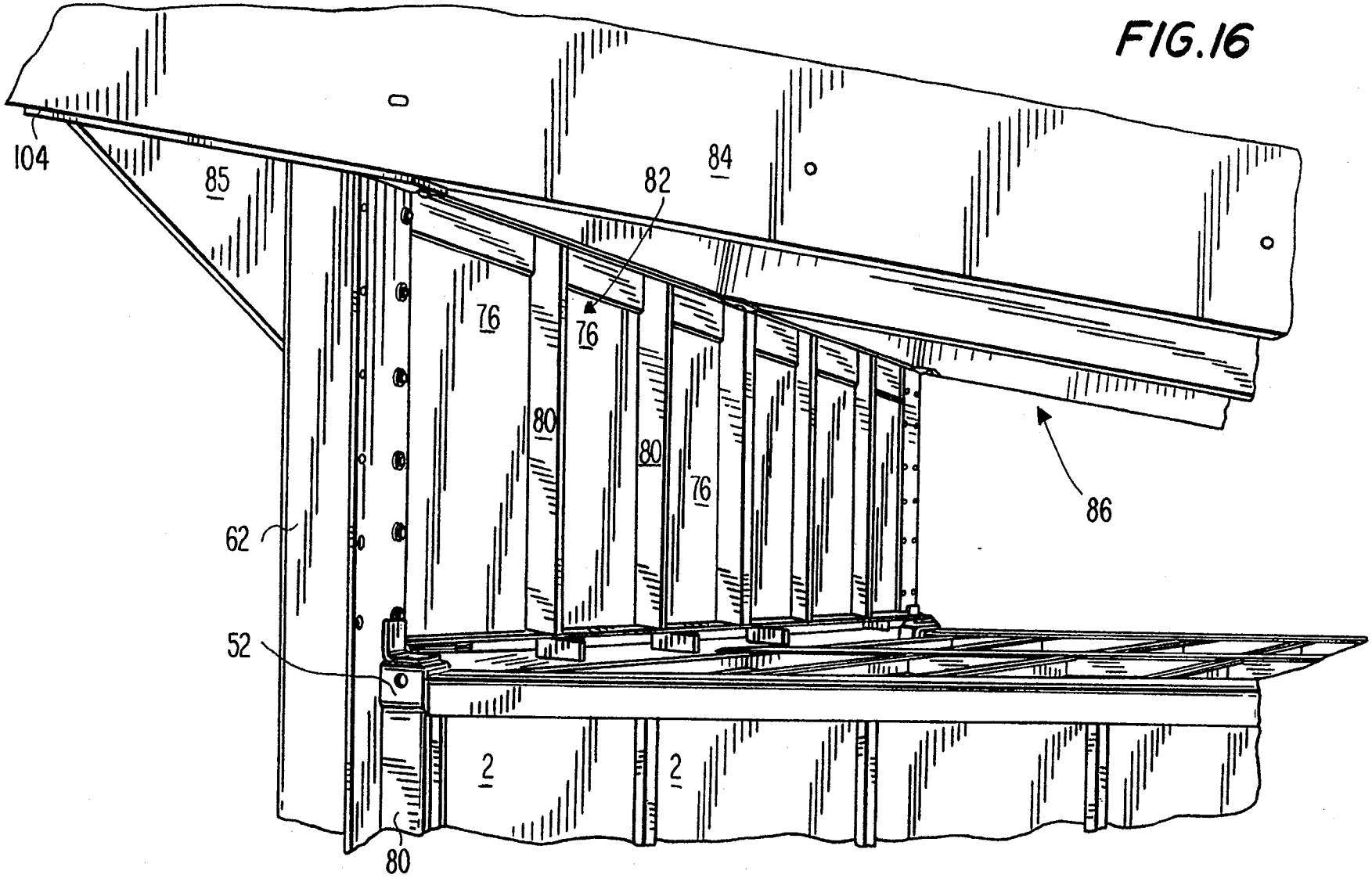
FIG. 16 is a perspective view of a column-girder wall-cell interaction of one embodiment of the present invention.
Figure 17:
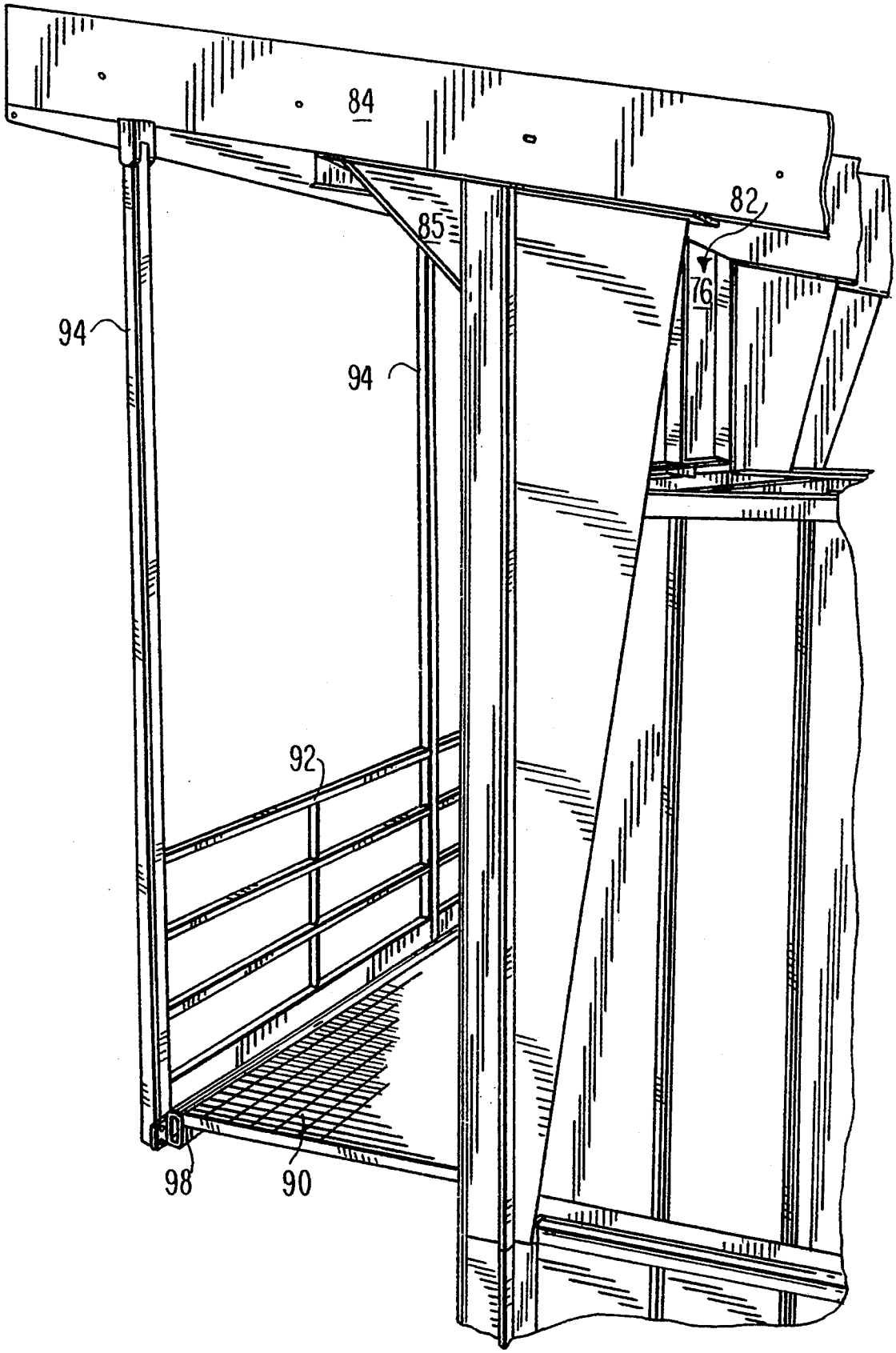
FIG. 17 is a perspective view of a column-girder wall-cell interaction of a second embodiment of the present invention.

The columns 62 are preferably deployed at the joint 72 between every other cell 1 (about 17 feet) along each of two opposing sides (FIG. 2). In the I-beam and hollow column embodiments, the columns 62 abut the outside faces 74 of the front walls 8 of the two cells 1 whose joint 72 they span and are fastened to the cells' front-most corner post 80 and the girder panels 76 above the cells 1 (see FIG. 16). In the T-beam column embodiment, the stem 78 of the beam fits into the joint between the two cells and the flange 79 is fastened to the corner post 80 of each of the cells 1 as well as the end of girder panels 76 (see FIG. 17).

Figure 18:
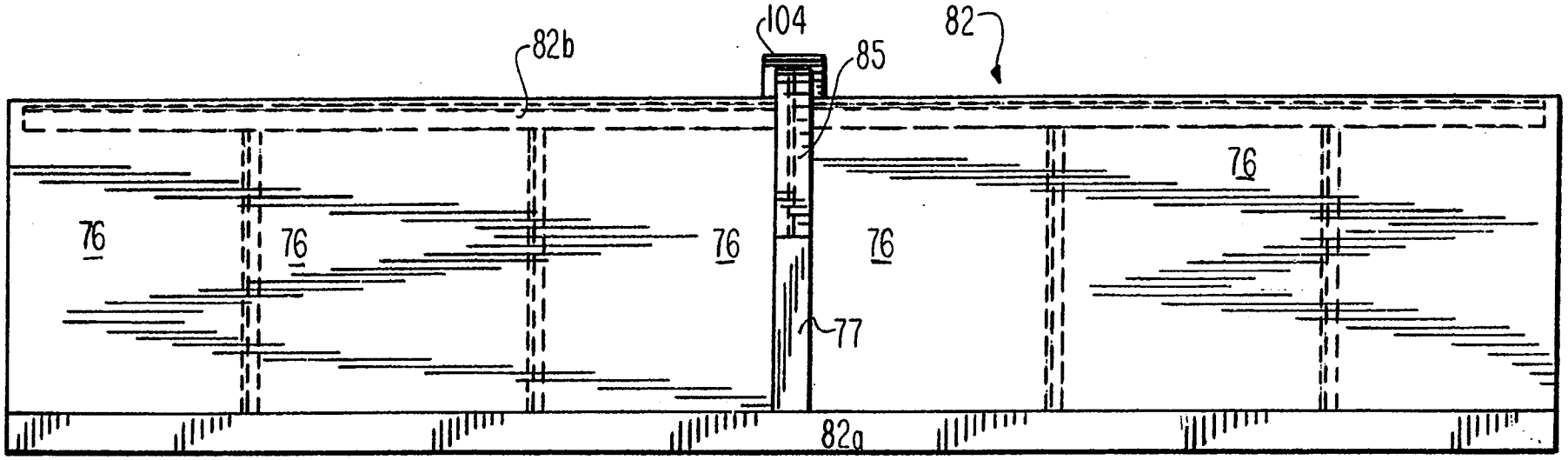
FIG. 18 is a front plan view of a girder wall of one embodiment of the present invention.

The girder panels 76 form the web of the girder 82 with the angle sections **82*a* and 82*b*, spanning the gap between the columns. This forms a closure between the uppermost cell and the supporting members (roof rafters) 84 of the roof panel 108 of the complete structure 100. The girders 82 are, as noted previously, affixed to the columns 62 by their endmost girder panels 76. Each column 62 is also affixed to the rafters 84 by a haunch 85 welded to each column at its upper end (see FIG. 18). The wall sections (girders) 82 provide lateral support to the structure 100 by acting as a web between the columns 62 and act as a support for the stub post 77. They also provide security by preventing prisoners from getting into the area above the cells. Insulation 83 is preferably placed directly above the upper-most cells 1 behind the girder wall 82 (see FIG. 24, described below). If desired, the secure area behind the girder wall 82 can be used for piping, wiring, and ventilation ducts. The gable end walls can house mechanical equipment or may be used as storage by providing locking doors (not shown) in place of one or more of the girder panels 76**.

Figure 19:
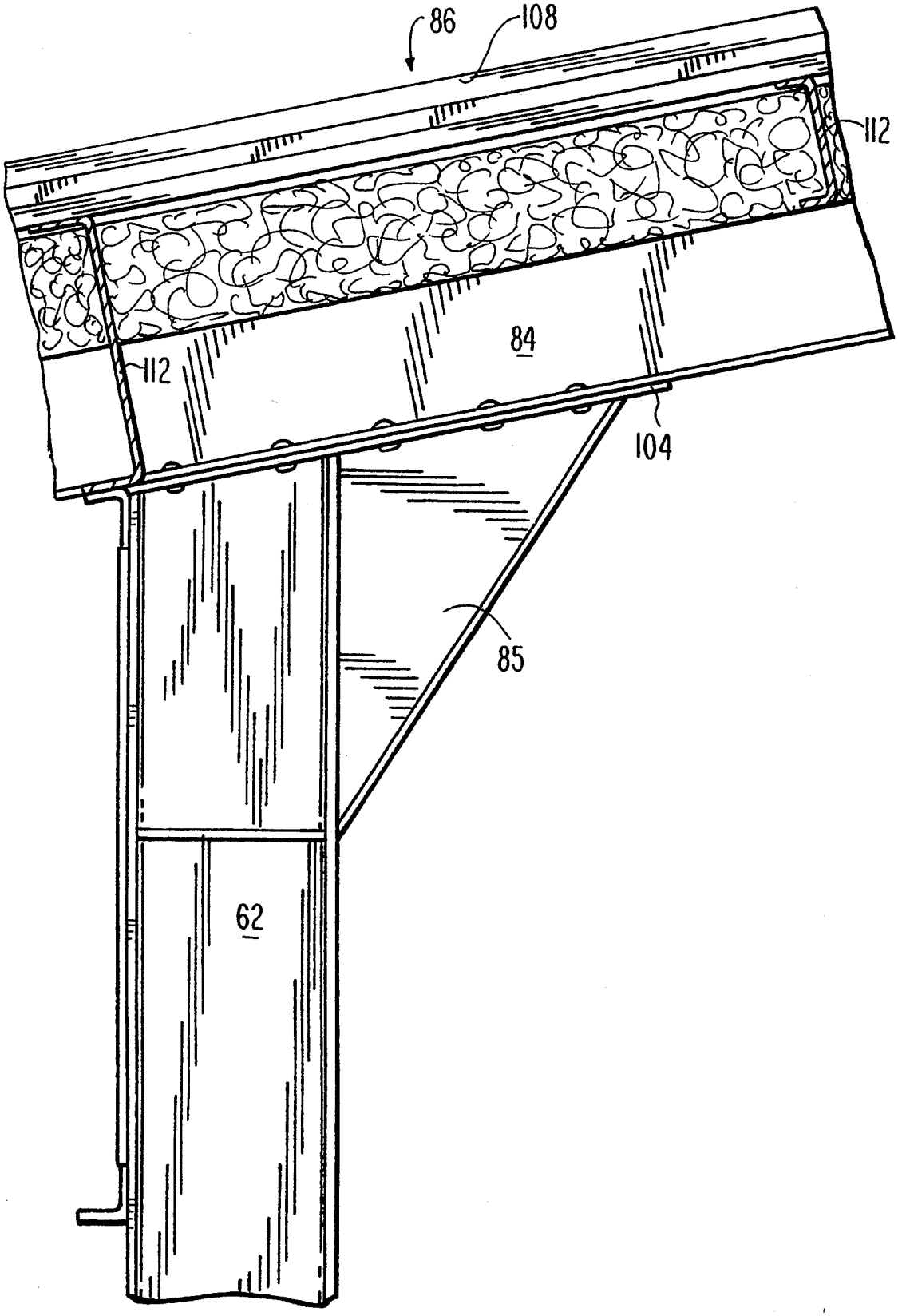
FIG. 19 is a cross-sectional view of a column to roof interaction in accordance with one embodiment of the present invention.
Figure 20A:
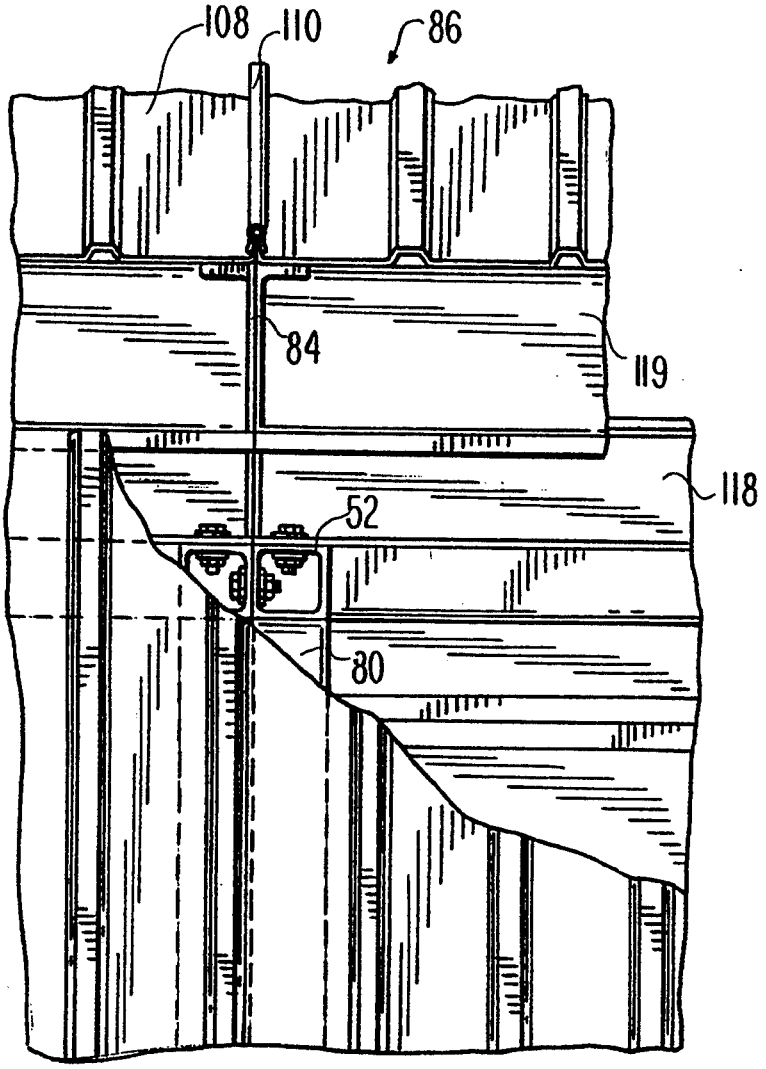
FIG. 20*a* is partial cutaway rear plan view of the cell to roof interaction of the complete structure in accordance with one embodiment of the present invention.
Figure 20C:
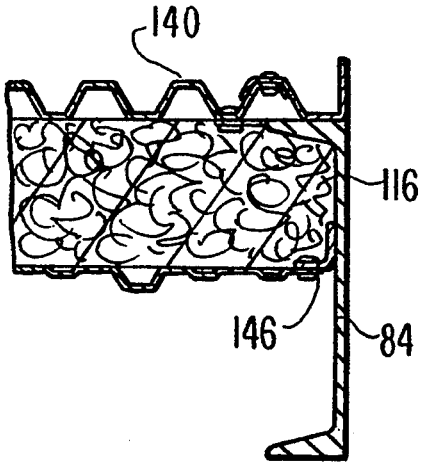
FIG. 20*c* is a cross-sectional view of the series of roof panels of FIG. 20*b* taken along line C—C.
Figure 20D:
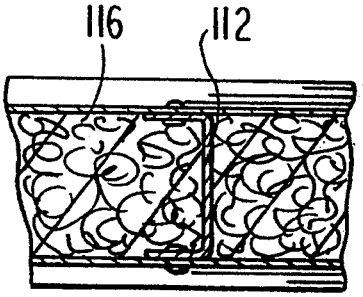
FIG. 20*d* is a cross-sectional view of the series of roof panels of FIG. 20*b* taken along line D—D.
Figure 20B:
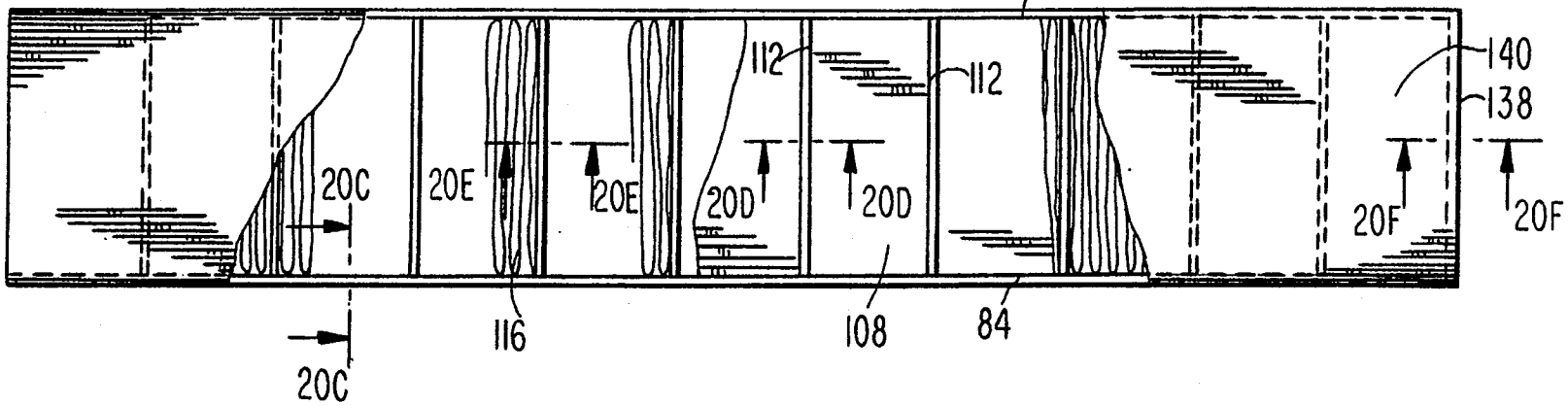
FIG. 20*b* is a partial cut away plan view of a series of roof panels.
Figure 20E:
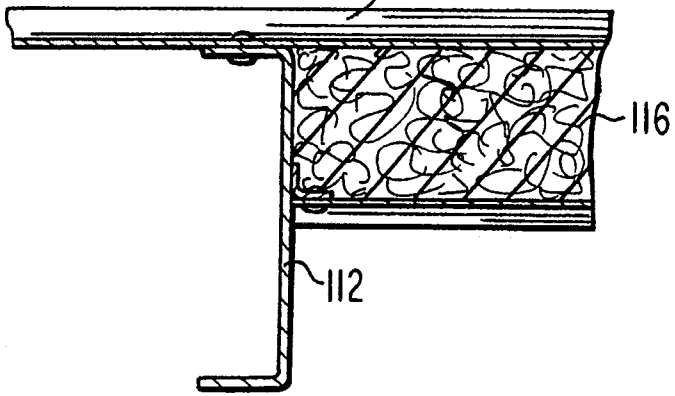
FIG. 20*e* is a cross-sectional view of the series of roof panels of FIG. 20*b* taken along line E—E.
Figure 20F:
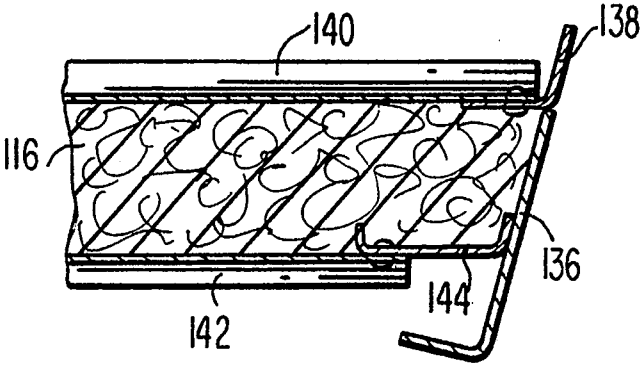
FIG. 20*f* is a cross-sectional view of the series of roof panels of FIG. 20*b* taken along line F—F.

Affixed to the top of each haunch 85 is a plate 104 which, in turn, is bolted or otherwise fastened to a roof rafter 84, as illustrated in FIG. 19. The haunches 85 provide rigidity at the column to rafter connection and distribute the weight from the roof rafters 84 more evenly to the columns 62 to avoid placing the entire load on a relatively few points.

Figure 21:
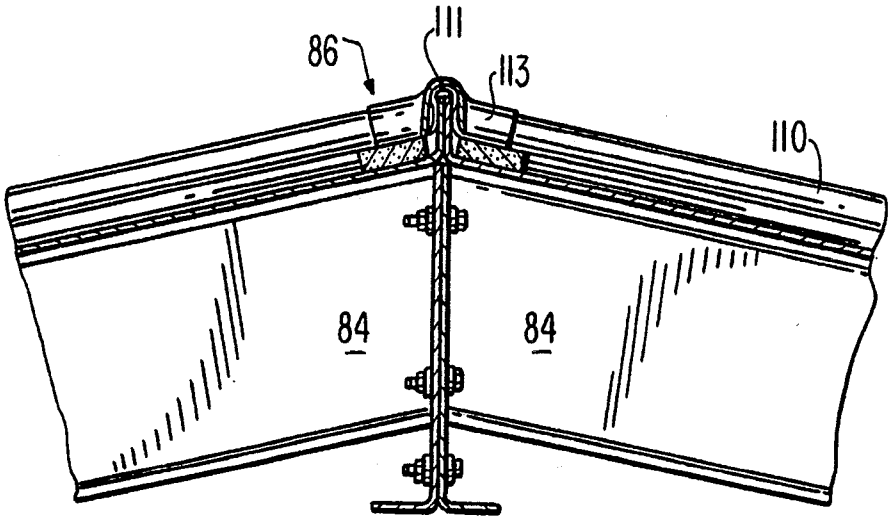
FIG. 21 is a cross-sectional view of the peak of the roof of the complete structure in accordance with one embodiment of the present invention.

As shown in FIGS. 19–21, the roof structure is composed of roof panels 108, splice caps 110, ridge caps 111, and ridge cruciform caps 113. The roof panels 108 are composed of rafters 84 connected by transversely spaced purlins 112, soffit/fascia 119, ridge members 136 and ridge angles 138. The outer roofing 140 is weather tight membrane which covers a vapor barrier and thermal break (not shown) and insulation 116 which in turn is enclosed by an inner perforated lining panel 142 for acoustical and security enhancement. The inner panel 142 is secured to ridge support angles 144, inner roof angles 146, and purlins 112.

The roof panels 108 are joined to one another by removable fasteners and in turn are joined to the columns 62 in a like manner. Weather tight seals between the roof panels are accomplished with ridge caps 111, splice caps 110 and ridge cruciform caps 113.

The roof structure, comprises roof panels 108, supported by columns 62 and stub posts 77 to provide protection from the elements. Panels 108 are bolted together and splice caps 110 join the roofing 140 together creating water tight seals. At the peaked center of the roof a ridge cap 111 is preferably used together with a ridge cruciform 113. The purlin channel 112 supports an inner roof liner 142 and insulation 116 which is placed above it. The insulation 116 thus is located within the area defined by the purlin 112 and the rafters.

Figure 23:
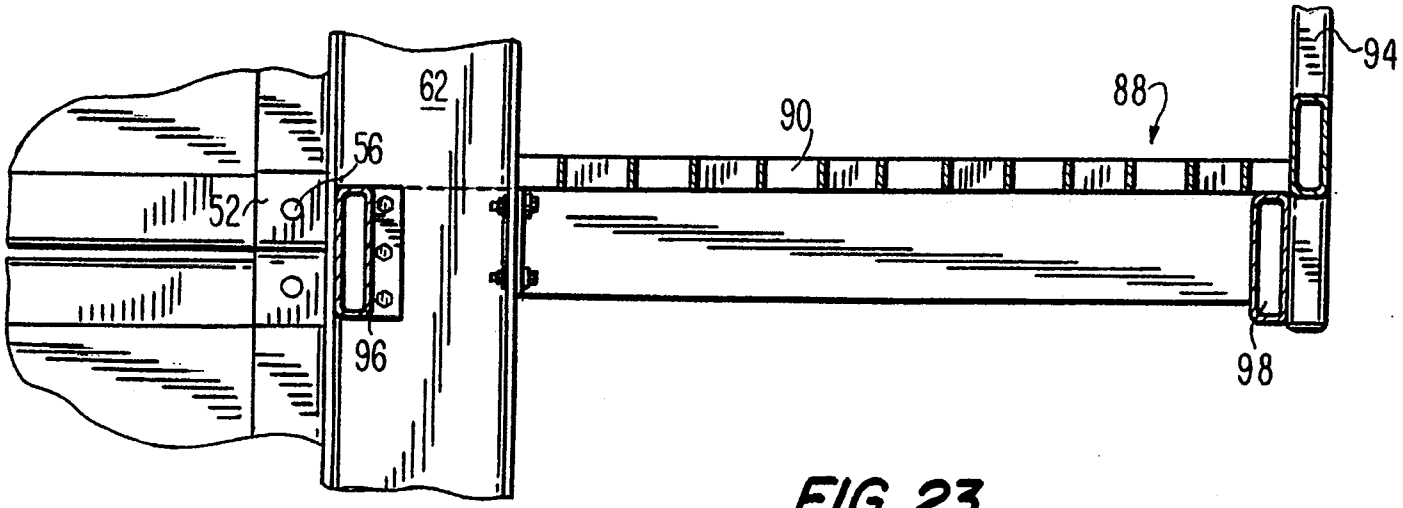
FIG. 23 is a cross-sectional view of a portion of a walkway made in accordance with one embodiment of the present invention.
Figure 22:
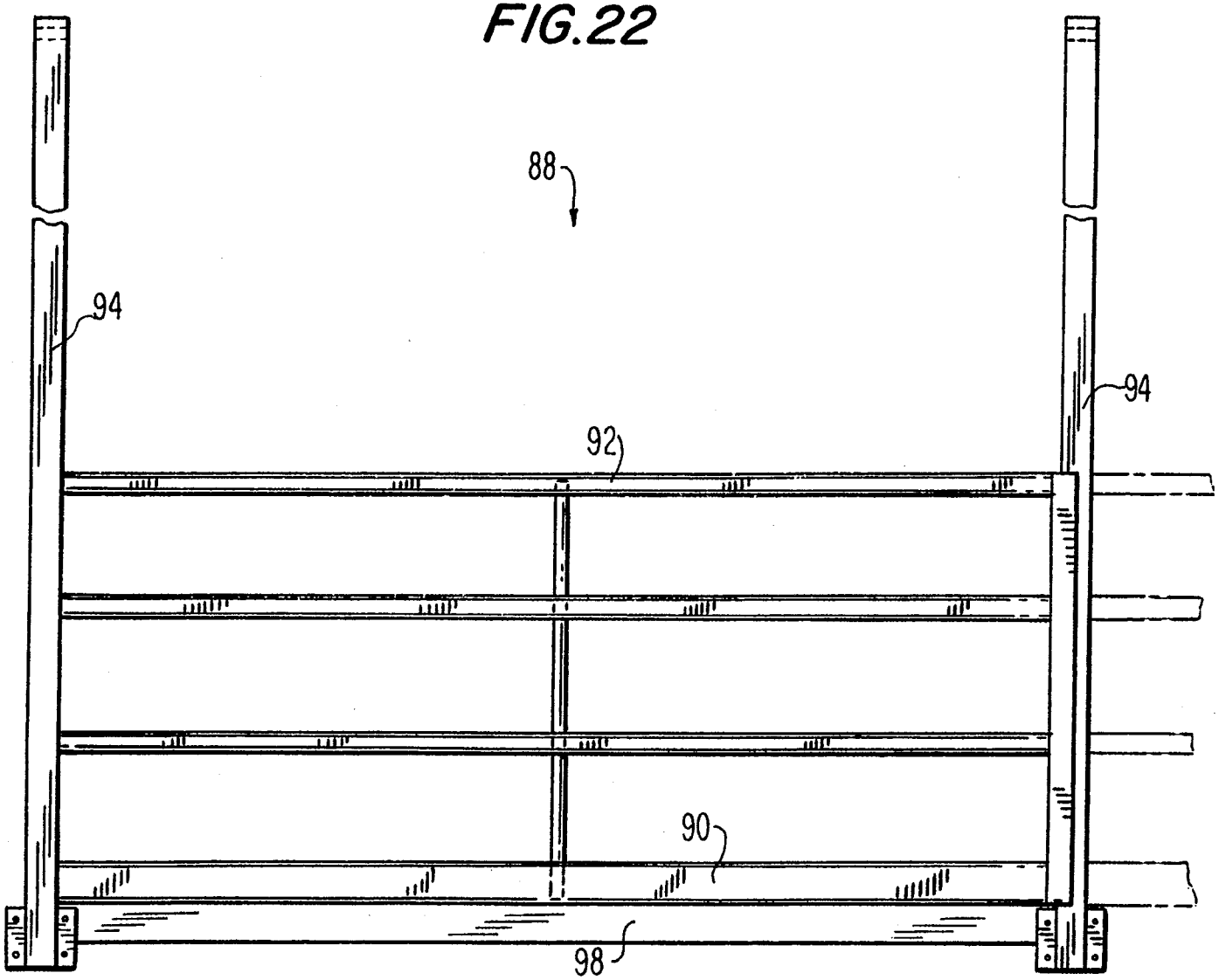
FIG. 22 is a front view of the walkway made in accordance with one embodiment of the present invention.

When the cells 1 are stacked to achieve multiple levels, as shown in FIG. 2, a walkway 88 preferably is provided to permit access to the upper level cells 1. As shown in FIGS. 22 and 23 the walkway 88 comprises a bed 90, preferably in the form of a steel grating (although solid decking with steel or concrete is also acceptable), a railing 92 and support hangers 94 on the outboard side. The bed 90 is supported by inboard and outboard runners 96 and 98. The inboard runner 96 is fastened to the front face of the front wall of the upper and lower cells 1. It may also be fastened, on either end, to columns 62, between which it extends in sections. The outboard runner 98 is attached to the lower end 102 of the support hangers 94. The support hangers 94, in turn, are hung from the roof rafters 84 which provide the majority of support for the walkway 88. The railing 92 is in sections which extend between each support column 94. Alternatively, the walkway may be cantilevered out from the cells or supported by columns below.

Figure 24:
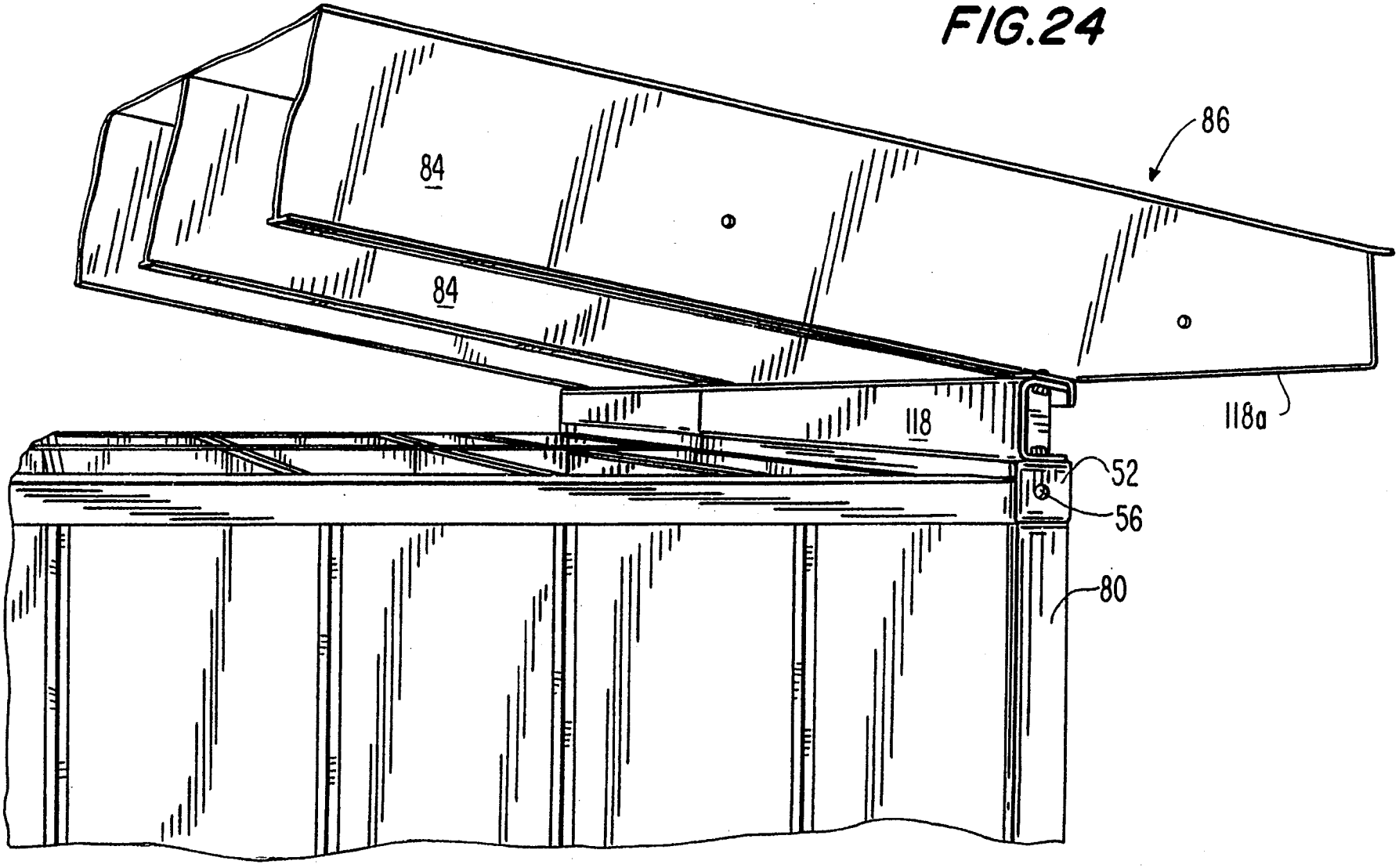
FIG. 24 is a prospective view of the knock-out member of the present invention.

As shown in FIG. 24 a connector channel or knockout member 118 spans the small gap between the top of the upper cells 1 and the rafters 84. It is attached to the rafters 84 and the corner posts 80 of the cells 1. The member 118 provides little or no support to the roof 108, but acts to tie the cells to that portion of the roof structure 108. If the cells are to be removed at a later time, the member 118 insures that sufficient space exists after it is removed to permit the cells 1 to slide out and thus be removed from the roof structure 108 and columns 62 without damage to the rest of the structure 100.

Figure 25:
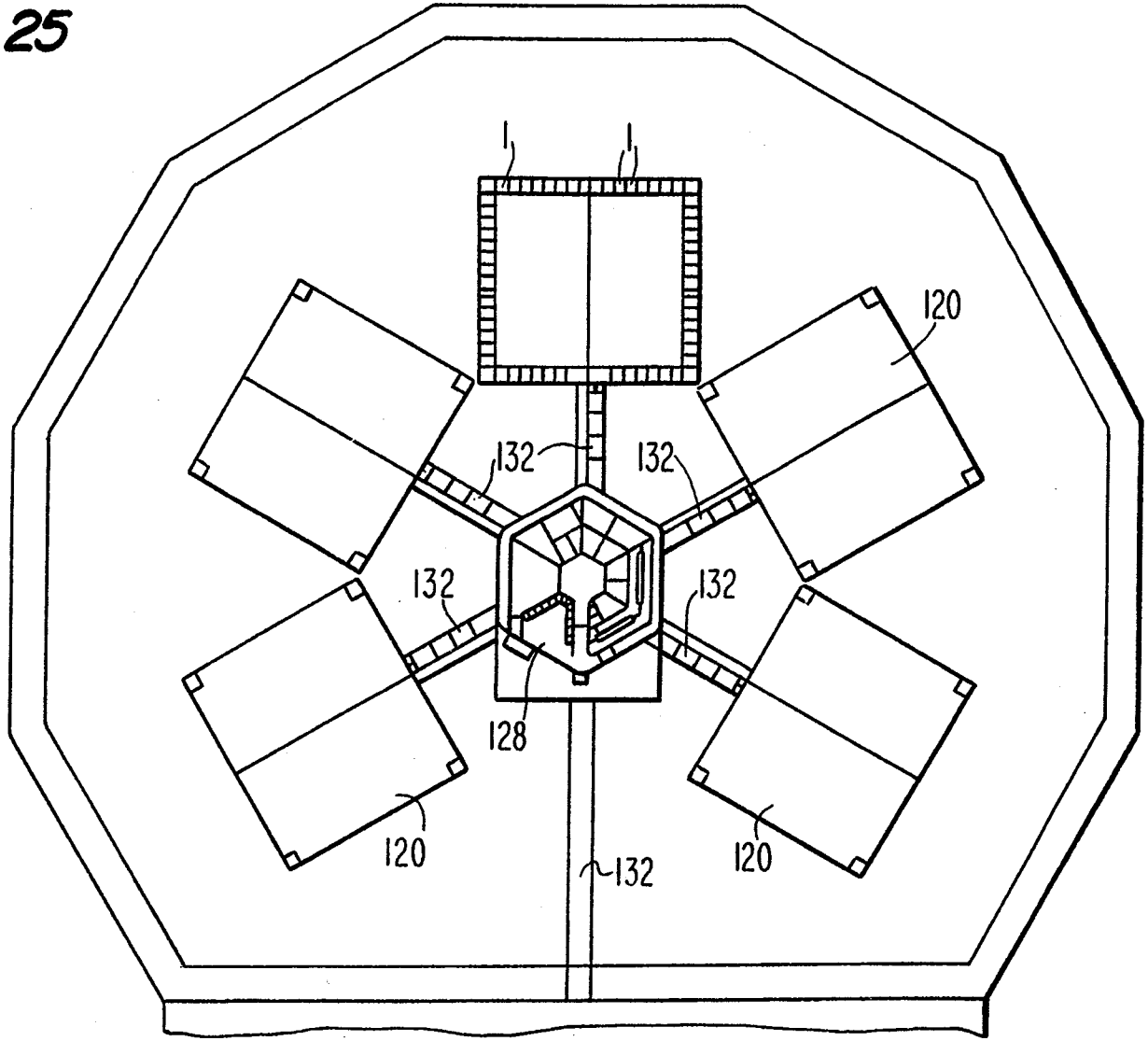
FIG. 25 is a top plan view of a complete prison facility made in accordance with one embodiment of the present invention.

In use, the cells 1 are pre-fabricated at a first remote site, transported to the site of the jail facility and where they are preferably deployed in a rectangular manner, stacked two high, as shown in FIGS. 2, 9, and 25, to form a wing 120. The cells are mounted on a foundation which is prepared at the site and is comprised of the lowered and raised slabs 44 and lower slab 48. The columns 62 are attached to the floor and coupled to the cells and/or girder walls 82, as appropriate, and the roof 108 is erected thereon.

The wing 120, if rectangular in shape, may be divided into two sections 122 and 124 with a secure firewall 126 to keep the number of inmates down to an acceptable number. If, however, a larger number of cells/inmates are desired in a given location, the cells can be stacked three or more high and additional firewalls can be added or the single firewall omitted completely.

Figure 26:
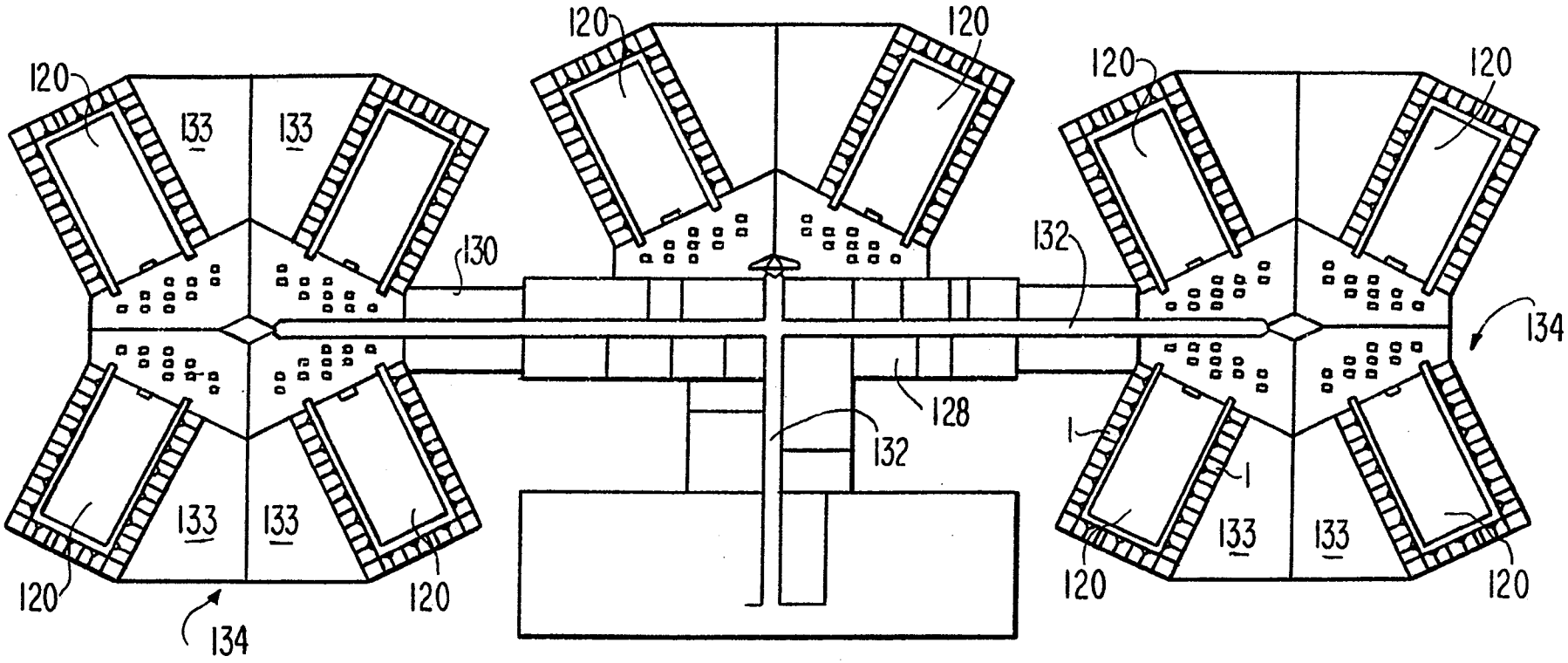
FIG. 26 is a top plan view of a complete prison facility made in accordance with a second embodiment of the present invention.
Figure 27:
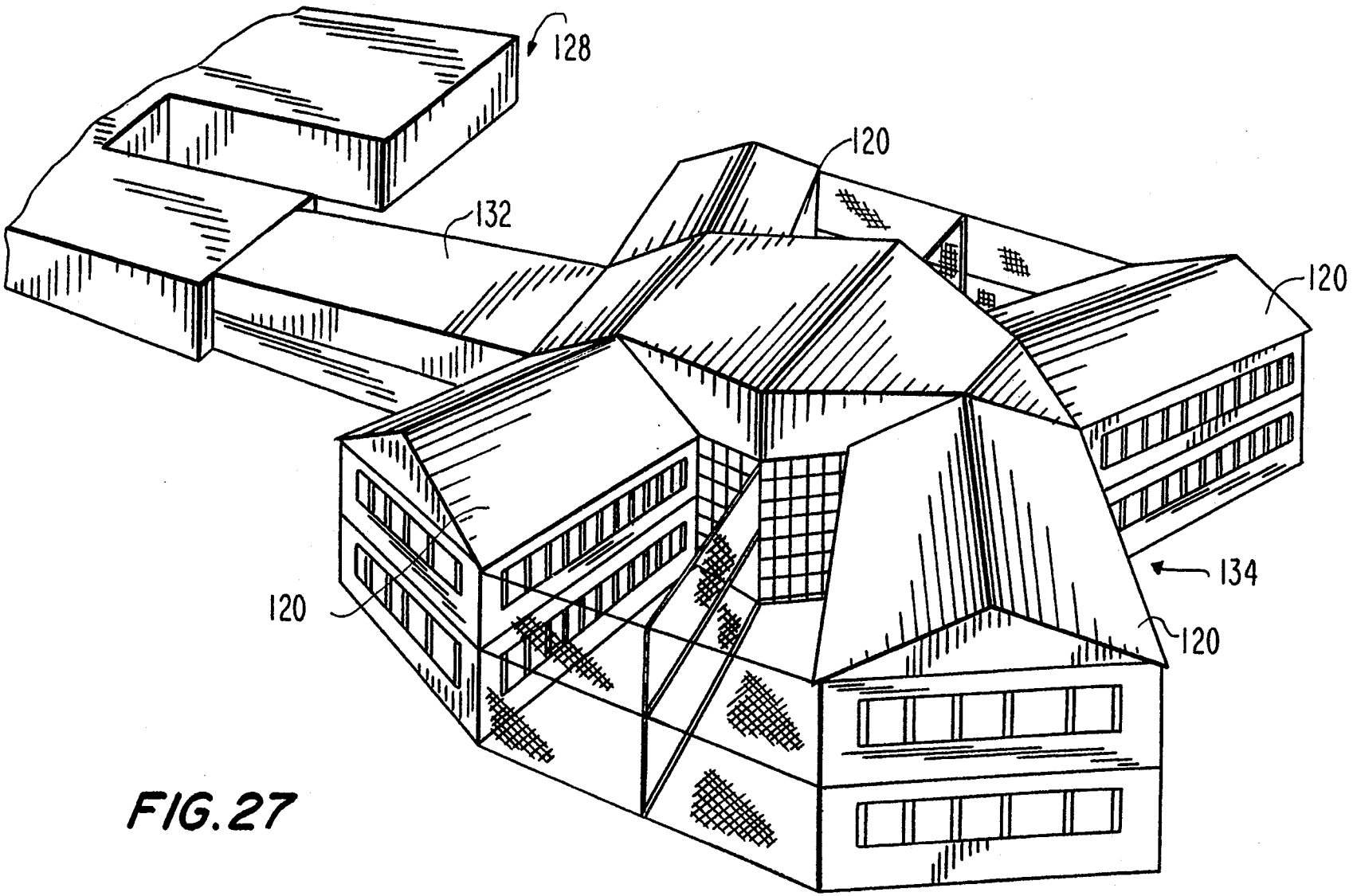
FIG. 27 is a perspective view of one of the quads shown in FIG. 26.

If the cells 1 of the present invention are used as part of a large installation, multiple 'U' shaped wings 120 may be employed. The additional wings 120 are preferably arranged in configurations as shown in FIGS. 26 and 27 around a common core forming a quad 134. Secure corridors 132 link the administration facility to each quad 134. In one embodiment (shown in FIG. 25) the administration building 128 forms the core around which all the wings 120 are arrayed. In a second embodiment (shown in FIGS. 26 and 27), a plurality of quads 134 and a half quad are either directly attached to the administration building 130 or linked by secure corridors 132.

When it is desired to remove the cells 1, the knockout member 118 is removed, as are any bolts connecting the cells 1 to the slabs. The bolts 54 connecting the cells 1 to each other preferably are also removed. If sufficient equipment exists to move very large loads, cells stacked one on top of another may remain bolted together (as could some of the cells in side-by-side relation).

After all of the cells 1 are removed from the structure 100, an open sided structure with a roof 86 supported by columns 62 remains. This structure can be dismantled for future use elsewhere or can be left at the site to be utilized for other functions. When the 'T' beam columns are employed, angles (not shown) are attached to the stem of the 'T' to form an 'I' beam. This compensates for the loss of the cells as supporting webs and allows the columns 62 to completely support the roof under all normal load conditions. Similarly, when the hollow beam columns are employed a backing piece (not shown) is connected to strengthen each column 62 to provide sufficient support for the roof panels 108. Finally, the lower slab 48 may be brought up to the height of the raised slab 44 with additional concrete and simple walls may be erected around the peripheral edge of the lower slab to quickly and inexpensively create a warehouse or the like. Thus, when the jail facility is no longer necessary, or it is desired to move it to another site, a useful structure may remain, and the cells and structure can be re-used at alternate locations.

As can be readily seen, the present invention provides significant advantages over the prior art. It provides a system and method which allows for continued use of a portion of the jail facility even after the cells have been removed. It also provides an efficient system and method for deploying modular cells in a prison facility.

While reference has been made to specific embodiments, one of skill in the art could modify these embodiments without departing from the spirit or intent of the present invention. Thus, neither the particular structural components nor the described dimensions should be construed as limited to those details disclosed herein as the disclosed embodiments are merely illustrative of the invention.

We claim:

1. A modular jail structure comprising:

a plurality of removable cells in adjacent relation arranged in a configuration to form an open area;

a plurality of support columns removably coupled to said plurality of cells; and a roof supported by said plurality of support columns, covering at least said open area, wherein said roof remains in place, supported by said support columns, when said plurality of cells are removed.

2. A modular jail structure according to claim 1, further comprising knock-out means spanning and sealing a gap between said roof and an upper portion of said plurality of cells to insure sufficient space exists between said roof and said upper portion of said plurality of cells to permit at least one of said plurality of cells to be removed without disturbing the remaining portion of the structure.

3. A modular jail structure according to claim 1, further comprising girder means connected to said plurality of support columns to provide additional support for said roof, and longitudinal rigidity to the structure.

4. A modular jail structure according to claim 3, wherein said girder means further comprises a stub post and haunch means connecting said girder means to said roof to better distribute the roof loads.

5. A modular jail structure according to claim 1, wherein said support columns are each connected to a haunch to more evenly distribute the weight from said roof to said support columns and to increase transverse rigidity.

6. A modular jail structure according to claim 1, wherein each of said plurality of cells includes a plurality of corner members for connecting each cell to a cell next to and/or below it, or to the foundation upon which it rests.

7. A modular jail structure according to claim 6, wherein each said cell has at least eight corners with one corner member at each of said eight corners.

8. A modular jail structure according to claim 7, wherein each said corner member is in the shape of a hollow cube with at least one open side.

9. A modular jail structure according to claim 8, wherein each said corner member has at least two holes for accommodating fasteners.

10. A modular jail structure according to claim 1, wherein each of said plurality of cells comprises at least four walls, a floor and a ceiling, wherein at least said ceiling and said at least four walls comprise a plurality of panels each having an inner wall face, said panels being joined together at first flanges bent back at approximately 90° from the inner wall face thereof.

11. A modular jail structure according to claim 10, wherein said ceiling is fastened to said at least four walls at second flanges of said walls panels bent back at least 90° from the inner wall face of each said panel.

12. A modular jail structure according to claim 1, wherein said cells are deployed in a multi-level arrangement and wherein said jail system further comprises walkway means, secured to the cells of an upper level, for providing access to cells above a first, ground level.

13. A modular jail structure according to claim 12, further comprising girder wall means for sealing off an area between cells in an upper-most level and said roof.

14. A modular jail structure according to claim 1, wherein said support column is in the form of an I-beam.

15. A modular jail structure according to claim 1, wherein said support column is in the form of a hollow beam having a U-shaped front portion connected to a backing plate, said backing plate being secured to at least one of said cells.

16. A modular jail structure according to claim 1, wherein said support column is in the form of a 'T', wherein the stem of the 'T' extends at least partially between adjacent cells, and the face portion of the 'T' is secured to at least one of said cells.

17. A modular jail structure according to claim 1, wherein each said plurality of cells includes a floor, joined at its peripheral edge to front, back and side walls of each said cell.

18. A modular jail structure according to claim 17, wherein said floor comprises a reinforced concrete slab surrounded by a frame.

19. A modular jail structure according to claim 18, wherein said front, back and side walls of each said cell are provided with holes and said frame includes matching holes to accommodate fasteners for joining a floor to each said cell.

20. A modular jail structure according to claim 19, wherein said cement slab has a top peripheral edge provided with a groove, said holes in said frame located proximate said groove, and said groove allowing fastener access to said holes in said frame.

21. A modular jail structure according to claim 20, wherein said floor is sloped away from one or more of said back, front and side walls towards a drain.

22. A modular jail structure according to claim 1, further comprising foundation means, wherein said foundation means comprises a central raised slab portion and a peripheral lower slab portion, said cells being supported on said lower slab portion.

23. A prison facility comprising:

a polygonal shaped central administration building;

a plurality of discrete wings arranged around said central administration building in a polygonal pattern, each wing including a plurality of jail cells arranged in side-by-side relation in a rectangular pattern around an open area, and each wing comprising a plurality of support columns coupled to said cells; and a roof, supported by said plurality of support columns, covering said plurality of cells and said open area, wherein said roof remains in place, supported by said support columns, when said plurality of cells are removed; and a plurality of corridors linking said wings and said central administration building.

24. A prison facility according to claim 23, wherein said central administration building is hexagonal shaped.

25. A prison facility according to claim 23, wherein each wing is divided into a plurality of sections by a dividing wall.

26. A prison facility comprising:

an administration building;

a plurality of quads arranged around said administration building wherein each said quad comprises four wings and wherein each wing includes a plurality of jail cells arranged in side-by-side relation in a rectangular pattern around an open area, and each wing comprising a plurality of support columns coupled to said cells; and a roof, supported by said plurality of support columns, covering said plurality of cells and said open area, wherein said roof remains in place, supported by said support columns, when said plurality of cells are removed; and a plurality of corridors linking said quads and said administration building.

* * * * *